US009368101B1

(12) United States Patent
Meyer et al.

(10) Patent No.: US 9,368,101 B1
(45) Date of Patent: Jun. 14, 2016

(54) DYNAMIC ACOUSTIC CONTROL SYSTEM AND METHOD FOR HOSPITALITY SPACES

(71) Applicant: Meyer Sound Laboratories, Incorporated, Berkeley, CA (US)

(72) Inventors: John Meyer, Berkeley, CA (US); Pierre Germain, Berkeley, CA (US); Roger Schwenke, Alameda, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 111 days.

(21) Appl. No.: 14/056,901

(22) Filed: Oct. 17, 2013

Related U.S. Application Data

(60) Provisional application No. 61/716,433, filed on Oct. 19, 2012.

(51) Int. Cl.
*G10K 15/08* (2006.01)

(52) U.S. Cl.
CPC ..... *G10K 15/08* (2013.01)

(58) Field of Classification Search
None
See application file for complete search history.

(56) References Cited

U.S. PATENT DOCUMENTS

| | | | | | |
|---|---|---|---|---|---|
| 2,542,663 | A * | 2/1951 | Graham | 381/63 |
| 3,406,385 | A * | 10/1968 | Lerner | 367/93 |
| 4,039,753 | A * | 8/1977 | Balogh et al. | 381/83 |
| 5,025,472 | A * | 6/1991 | Shimizu et al. | 381/63 |
| 5,119,428 | A * | 6/1992 | Prinssen | 381/83 |
| 5,729,613 | A | 3/1998 | Poletti | |
| 5,862,233 | A | 1/1999 | Poletti | |
| 6,157,724 | A * | 12/2000 | Kawakami | 381/63 |
| 6,608,903 | B1 * | 8/2003 | Miyazaki et al. | 381/17 |
| 7,233,673 | B1 | 6/2007 | Poletti | |
| 2005/0137859 | A1 * | 6/2005 | Yoshino | 704/205 |
| 2010/0104114 | A1 * | 4/2010 | Chapman | 381/103 |

OTHER PUBLICATIONS

M.A. Poletti, The Performance of Multichannel Sound Systems, Oct. 1999, University of Auckland.

* cited by examiner

*Primary Examiner* — Thang Tran
(74) *Attorney, Agent, or Firm* — Beeson Skinner Beverly, LLP

(57) ABSTRACT

An acoustic control system for hospitality spaces includes a passive component (17) for producing a baseline reverberation time (RT) value within the space, and an active component ($L_N$, $M_N$, 15) for picking up sounds in the space (11) and reintroducing the sounds into the space such that the reintroduced sounds have an RT value and sound level capable of being adjusted and such that the resulting RT value can be adjusted to a relatively large value as compared to said baseline RT value.

8 Claims, 3 Drawing Sheets

DYNAMIC ACOUSTIC CONTROL SYSTEM AND METHOD FOR HOSPITALITY SPACES

CROSS-REFERENCE TO RELATED APPLICATIONS

This application claims the benefit of U.S. provisional patent application No. 61/716,433 filed Oct. 19, 2012, which is incorporated herein by reference.

BACKGROUND

The present invention generally relates to systems and methods for controlling the acoustic environment of a space and more particularly to a system and methods for controlling acoustic environments within venues used for hospitality purposes, such as restaurants.

The escalating noise levels in restaurants have become an acute problem for restaurant owners, whose patrons increasingly complain of excessive noise levels. Owners who attempt to solve the problem typically resort to one-size-fits-all solutions, which rarely produce acceptable results. The problem is the number of variables that contribute to the acoustic environment, all of which are not easily controlled. Complicating matters are conflicting goals of restaurant owners: they may want to have a buzzing restaurant—but not too loud, and they may not want it buzzing all of the time, and/or not everywhere in the establishment.

These varied demands present daunting challenges for audio and acoustical professionals called upon to provide solutions to the problem of excessive noise or the perception of excessive noise in restaurants. In most cases, no single contributing factor is fully responsible for this problem. Rather, the culprit is a fluid mix of changing architectural and cultural trends along with the way humans tend to vocalize in acoustically stressful environments. With respect to architecture, most fine dining used to take place in a lush environment of velour drapes, thick carpets, and plush padded seating. The kitchen was far off in an unknown and unheard location. Today, patrons of trendy top flight restaurants are more likely surrounded by exposed concrete, brick, tile, hardwood, and mirrors. Often kitchen noise comes clattering through an open serving window. The combination of hard materials in a relatively small space means that there is little sound dissipation, resulting in longer reverberation times and louder rooms.

Further, in many restaurants up-tempo foreground music is piped into the environment, often at fairly high sound levels. This factor is, at least theoretically, under control of restaurant management. However, often management's choice is to maintain a music level well above the general noise level, and in a lively acoustical environment that can be very loud.

The final contributing factor is the patrons themselves. When more patrons are talking in a restaurant, the ambient noise level rises. And the higher the ambient noise level, the louder the patrons talk. When music levels and ambient noise creep past some critical level (which can vary with the demographics, primarily age, of the people occupying the restaurant space), the restaurant approaches a threshold where higher sound levels can cause extreme patron dissatisfaction and the loss of business.

Excessive restaurant noise also affects employees. It has been reported that waiters and waitresses have suffered recurring headaches and temporary hearing loss.

Traditional acoustical treatments, judiciously used, can ameliorate some of the above-mentioned excessive noise problems. But balanced and effective acoustical treatments require careful on-site testing, diligent planning, and close coordination with architects or interior designers who can be more concerned about appearances than noise. In most cases, such acoustical treatment will aim for a best compromise: not so dry that it sucks life out of the room when occupancy is low, but still damping it enough to quell the din when the room is packed with a lively crowd. Such compromises cannot account for changing conditions and changing objectives for the acoustic environment. For example, often with an ownership or management change, the restaurant will target a different demographic, which may mean the desire for a livelier room for a young crowd or something quieter for older clientele. Such a change is likely to require an acoustical makeover of the premises.

The present invention is a dynamic acoustic control system that provides a dynamic approach to controlling the acoustics within a space, such as in restaurants, and that allows a number of variables influencing the acoustics within the space to be addressed and controlled on the fly. The invention also provides a solution to the existing problem in the restaurant industry allowing trendy eateries to maintain a "lively buzz" without subjecting customers and employees to annoying and even potentially harmful noise levels.

SUMMARY OF INVENTION

The system of the invention is comprised of two basic components deployed within a space used for hospitality purposes where people gather and engage in conversation within conversation areas, and where there will be some level of background noises and sounds, such as background music mixed with distant conversations. One of the basic components is a passive component for producing a baseline reverberation time within the space, and particularly within conversation areas of the space, which is relatively short, preferably no greater than about 700 milliseconds. The passive component is supplied by placement of acoustic absorption materials (also referred to herein as "passive treatments") to surfaces within the space, typically on both the ceiling and wall surfaces. The other basic component is an active component, which is an active acoustic control system that picks up the sounds of the space and reintroduces the sounds into the space such that the reintroduced sounds have an RT value capable of being adjusted and such that the resulting RT value of the space can be adjusted to a relatively large value, for example about 1500 milliseconds, as compared to the baseline RT value. As used herein, the "RT value" or "RT" for a space will be understood to mean RT60, that is, the time it takes for the sound to diminish 60 db below the original sound.

The method of the invention includes evaluating the hospitality space and applying passive treatments to the space and providing an active component. To apply the passive treatments, the passive acoustic parameters (baseline RT value or values) are established. The passive treatments are then added as needed to achieve the target baseline RT, particularly in conversation areas of the space. The RT of the space can then be measured and additional passive treatments added as needed. The result is a relatively steep reverberation slope, at least within the conversation areas. The remaining steps are to establish the active acoustic parameters for the space and add the elements of the active acoustic control system, including microphones and speakers, to the space for achieving the functional conditions in the space that meet the established active acoustic parameters, wherein the active acoustic control system can be adjusted as needed based on the occupancy conditions of the space.

DETAILED DESCRIPTION

Figure 1:
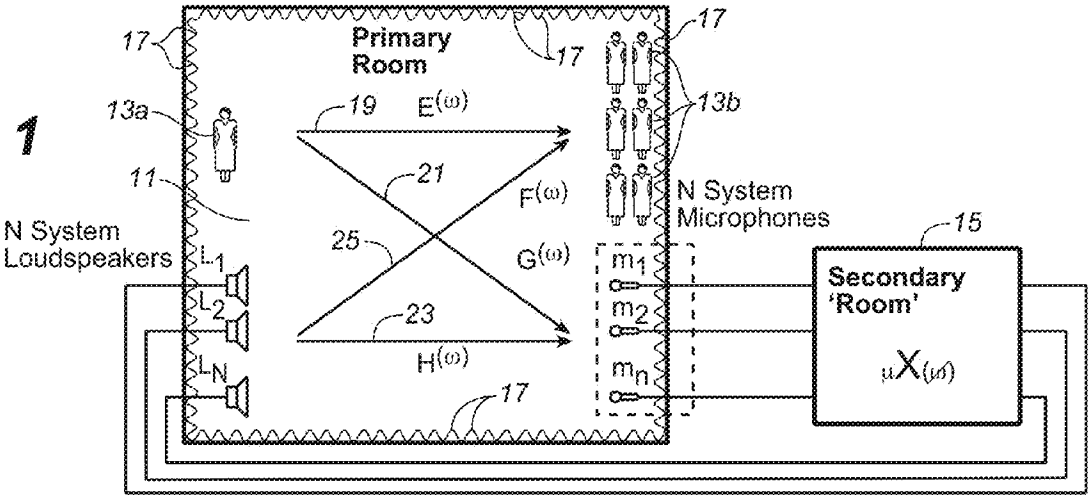
FIG. 1 is a diagrammatic view of a hospitality space employing active and passive components of a dynamic acoustic control system in accordance with the invention.

While the invention is described herein in reference to a restaurant environment, it will be understood that the invention could as well be used to control the acoustic environment of other hospitality spaces having similar needs and considerations. A primary objective of the invention is to provide hospitality venues the ability to regulate perceived sound levels in their space, thereby creating pleasant sonic environments where patrons do not need to shout to hear each other above the background noise within the venue. The combination of the passive and active components are used to create a sonic environment analogous to a shallow depth-of-field photograph: the passive component absorbs sound which allows sound levels to remain at a low level, where conversations can be understood at normal conversational levels, while the active component of the system creates a sonic "blur" of the background noise, which provides a sense of isolation and speech privacy.

In describing the invention, it is important to identify the contributors to the noise environment in a typical restaurant space and the nature of the contributions. There are basically three direct contributors: the people in the space, kitchen noise, and background music. Of these contributors, only one—the background music—is fully controllable. The challenge with background music, at least for establishments seeking a youthful crowd, is to make the music seem loud enough without it becoming excessively loud. The contribution from kitchen noise results from sounds generated in the kitchen area of the restaurant bleeding into the seating areas. This contribution can often be controlled to some extent; however, overall kitchen noise is a marginal contributor to environmental noise and it usually affects only a small portion of the restaurant. That leaves the least controllable contributor: the people in the restaurant. Ambient noise generated by patrons will vary depending on the number of people, and that in turn usually varies by time of day and by the day of the week. Also, the number of people who are speaking at any moment will vary as well. For example, a weekday lunch crowd may have silent solo patrons as well as group business lunches where one person will talk while four or five listen. So whereas the lunch crowd could have a 3:1 ratio of silent to speaking patrons, the late dinner crowd likely would be closer to 1:1. Other variables that may influence patron-generated noise include the age of the patrons and the consumption of alcoholic beverages.

Furthermore, vocally generated noise, that is noise generated by people talking in the restaurant, will often tend to escalate over time. In a phenomenon known as the Lombard effect, people with normal hearing will raise their voices when subjected to higher ambient noise levels. When ambient noise exceeds 45 dBA (a decibel level with a weighting filter that is tailored to the human perception of sound), speech levels gradually increase from a relaxed 54 dBA to a near-shouting 78 dBA when ambient noise exceeds about 92 dBA. In a closed and reflective acoustical environment, the Lombard effect can self-generate substantially higher noise levels independent of external noise factors.

In restaurant and similar hospitality environments where the acoustical requirements can vary frequently within a day, the ability to actually alter the acoustic environment to meet these changed conditions would have considerable appeal. Changing physical acoustics generally is not a serious option, as this would require changing the volume of the space, and/or the amount and proximity of reflective and/or absorptive surfaces in the space, and/or the reflective or absorptive characteristics of such surfaces at different frequencies. In a restaurant, this might be achieved by opening and closing multiple doors to the outside, opening and closing drapes, installing or removing carpets, and changing wall decorations.

However, another possibility is to electronically vary the acoustics of a space. Active acoustic systems for controlling acoustic environments are known and have improved dramatically in recent years. Such active systems are disclosed in U.S. Pat. Nos. 5,862,233, 5,729,613, and 7,233,673 all issued to Mark Poletti ("Poletti patents"). In these types of systems, the acoustic characteristics of a large listening space, such as an auditorium or concert hall, are augmented by early reflections and late reverberant fields created using arrays of microphones and loudspeakers distributed throughout the space. After the microphones pick up the ambience of the physical acoustics, digital signal processing (DSP) engines can adjustably create a desired balance of early reflections and late reverberations using prescribed algorithms for large static acoustic environments.

However, the use of active acoustics designed for auditoriums and concert halls as disclosed in the Poletti patents has heretofore not been considered practical in a restaurant setting or other similar hospitality venue because the acoustic environment and objectives for acoustic control in such hospitality spaces is dramatically different than in a concert hall. In a concert hall, the goal is to envelop both the performers on stage and the audience in a common acoustical environment, one where everybody shares the same immersive experience. This is not true in restaurants and other hospitality settings.

In accordance with the present invention, a unique approach has been discovered for using active acoustic environment control systems such as above described in combination with passive acoustic control components within a hospitality setting, such as in restaurants, to create acoustic environments (or "acoustic bubbles") within conversation areas or zones of the hospitality space. The acoustic bubbles allow people within the conversation areas to comfortably converse, such as across a dining table, while experiencing a sense of an active background sound energy or buzz in the space. Also, because the acoustical characteristics can be precisely calibrated for different conversation areas within the space, and adjusted as needed at different times of day and for different occupancy levels, the desired effect can be maintained despite changing conditions in the restaurant environment.

In accordance with the most general aspects of the invention, passive acoustical treatments are selected and placed within the space to establish a baseline acoustic condition within the space which has the driest desired characteristic. An active acoustic component, which includes microphones and speakers and a digital signal processing (DSP) engine, is then deployed to adjustably augment the physical acoustics in the space. In larger hospitality settings, multiple DSP engines can be used to supply different acoustical characteristics or "signatures" to different areas within the space, for example, a quieter zone for a VIP dining area and much livelier zone for the bar area.

More specifically, the passive component of the system of the invention is an acoustic absorption component that can be in the form of porous acoustic room surface treatments such as fiberglass, cotton, wood fiber or foam. The passive treatments are selected and placed throughout the space to reduce the reverberation time (RT) of the space and particularly of designated conversation areas within the space to a baseline value no greater than about 700 milliseconds, and preferably no greater than about 500 milliseconds. A suitable target RT value range for the deployed passive treatments is between about 300 to 700 milliseconds, and preferably between about 300-500 milliseconds. Generally, the baseline RT value achieved with the passive treatments will depend on the size of the space, with larger spaces having higher baseline RT values than smaller spaces.

The placement and the amount of passive treatments are important to achieve a suitably low baseline RT value and to achieve low baseline RT values within designated conversation areas. Placement and the amount of the passive treatments will depend on the architecture of and the building materials used in the space. However, generally it has been found that to achieve a sufficiently low baseline RT most of the ceiling (about 90%-100%) and about 30% to 60% of the wall surfaces will need to be treated. The wall surfaces are preferably provided with passive treatments suitably up to about seven feet off of the floor and in most cases suitably between three and seven feet off of the floor, it being understood that passive treatments outside of these height ranges are considered within the scope of the invention. Passive treatments are preferably placed adjacent conversation areas where possible.

Effective passive wall treatments can be provided in the form of wall mounted decorative acoustic panels hung on the walls, and most suitably next to the identified conversation areas of the space. An example of such commercially available decorative acoustic panels is the Libra Acoustic Image System manufactured by Meyer Sound Laboratories, Incorporated, of Berkeley, Calif.

The active component of the system is provided by an active acoustic enhancement system such as disclosed in the Poletti patents which are incorporated herein by reference. A commercially available active acoustic enhancement system is the Constellation™ system manufactured by Meyer Sound Laboratories, Incorporated. Such an active system includes microphones and speakers deployed within the space, most suitably in overhead areas. It further includes a digital signal processor (DSP) for processing sound input picked up by the microphones and reintroducing the sound into the space. The digital signal processor can be provided in the form of a controller with a display that allows the RT value to be adjusted.

The active component of the system can be used to increase the RT value of the space to values higher than the space's baseline value. In accordance with the invention, the active component can be used to adjust the RT value of the space for background sounds (or noise) to account for different levels of occupancy in the room. At low occupancies, the RT is set to its highest value, for example about 1.5 seconds, and at high occupancies, the RT is set to its lowest value, which suitably can be at or near the baseline value established by the passive component of the space. Generally, it is contemplated that the largest RT value that the active component would be adjusted to would be about 2500 milliseconds (or 2.5 seconds).

The sound energy level in the space will increase and decrease proportionally to changes in the RT value of the active component of the system: the lower the RT value the lower the sound energy, and the higher the RT value the higher the sound energy. A controller for the active system can be used to adjust the active component RT value and thus the sound energy in the space. The controller can suitably be an easy to use laptop, touch panel, tablet or smartphone.

Example: a 3,000-square-foot restaurant can have a ground floor space with exposed concrete and hardwood floors. Passive acoustic treatments can be provided throughout the space. The treatments can include applying acoustically absorbent material to the ceilings to heavily damp the ceilings, and hanging or securing acoustically absorbent elements to the walls, such as decorative acoustic panels that display artwork that conceal acoustic materials that are selected for the right level of absorption. The active component of the system is an active acoustic control non-in-line enhanced reverberation system that can include about 28 small condenser microphones distributed about the space and suitably suspended from the ceiling. These microphones will pick up ambient sound in the space. The active component can additionally include about 83 ceiling suspended small self-powered loudspeakers plus 12 ceiling suspended miniature subwoofers for extending the system's low-frequency range. The microphones and speakers are all small enough to be visually unobtrusive. When the active acoustic control system is set to a short reverberation setting, the space can accommodate a very lively late-night crowd, with quite high music levels, and still allow comfortable conversations across the table. When the crowd sound levels are lower, it can be set to a longer reverberation setting. When in a longer reverberation setting, the background sounds picked up by the active system are reintroduced into the space with longer RT values. Because of this acoustic augmentation, the space still maintains a lively "buzz." This control, provided through the DSP unit of the active control system, can be enabled easily via a hand held device such as an iPad™.

The above-described system and method for controlling acoustic environments in hospitality spaces are illustrated in the drawings, wherein FIG. 1 graphically depicts a hospitality space 11 populated with people 13*a*, 13*b* located within the space. The active component of the illustrated system is an enhanced reverberation system comprised of N system microphones $m_1, m_2 \ldots m_N$ for picking up sounds in the space and N system loudspeakers $L_1, L_2 \ldots L_N$, for reintroducing sounds into the space with an adjustable RT value. The microphones and loudspeakers are located in hospitality space 11 remote from the people in the room for creating a non-in-line reverberation system. As above-described, the loudspeakers and microphones are suitably mounted in overhead regions of the hospitality space, such as to ceiling or high wall surfaces, or overhead beams, and are suitably oriented to receive and reintroduce ambient sound into the space. The enhanced reverberation system is seen to further comprise a "secondary room," denoted by the numeral 15, which provides an "electronic space" for processing, most suitably through digital signal processing, the inputs from microphones $m_1$, $m_2$ . . . $m_N$. The processed signals produce enhanced sound that is reintroduced into the physical space through loudspeakers $L_1$, $L_2$ . . . $L_N$. Acoustic control of the physical space is achieved in the "secondary room," which acts as a controller which can be remotely operated.

The passive component of the system illustrated in FIG. 1 is graphically represented as acoustic absorption treatments 17 on surfaces within the hospitality space 11. In virtually all cases, this would include treatment of at least the ceiling surfaces of the space; in most cases this would also include applying treatments on portions of some or all of the space's surrounding walls. Examples of such treatments have been earlier described along with suitable ranges for the areas of the ceilings and walls that would typically be covered. The passive treatments need not be uniformly distributed in the space, but as above-described can be strategically deployed to create acoustic environments or bubbles within conversation areas or zones within the space.

The transmission of acoustic energy within the space is represented by the transfer functions denoted in FIG. 1, wherein E(ω) represents sound transmitted to the listener directly from the source, such as a conversation by person 13*a* heard by persons 13*b* via a sound path represented by arrow 19; G(ω) represents ambient sounds generated in the space such as by person 13*a* that is received by the distant microphones of the non-in-line enhanced reverberation system as indicated by arrow 21; H(ω) represents enhanced reverberant ambient sound (that is, the cumulative sound from all sources in the space) reintroduced into the space by the enhanced reverberation system and fed back to the active system, as represented by arrow 23; and F(ω) represents reverberant ambient sound reintroduced into the space by the enhanced reverberation system that is heard by persons in the space, such as by persons 13*b* as represented by arrow 25. The RT value of the space for sound reintroduced into the space can be adjusted by making adjustments within the "secondary room" of the enhanced reverberation system. μX(ω) indicates the adjustable transfer function of this secondary room.

Figure 2A:
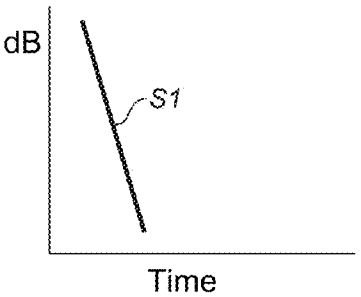
FIG. 2A is a graph showing the relatively steep reverberation slope produced by the passive component of the dynamic acoustic control system illustrated in FIG. 1.
Figure 2B:
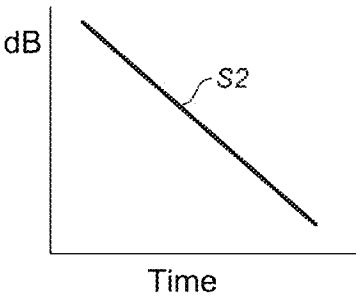
FIG. 2B is a graph showing the relatively long or shallow reverberation slope produced by the active component of the dynamic acoustic control system illustrated in FIG. 1.
Figure 2C:
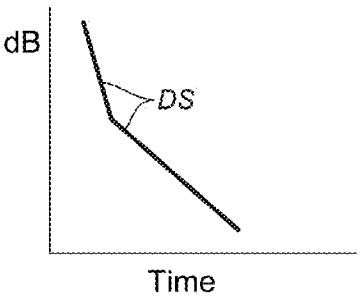
FIG. 2C is a composite of the graphs shown in FIGS. 2A and 2B showing the resulting "double sloping" of the reverberation slope.

The effects of the active and passive components of the acoustic control system shown in FIG. 1 are illustrated in FIGS. 2A-2C. FIG. 2A shows the reverberation slope (decay) of the space produced by the passive component of the system, such as the passive acoustic absorption treatments 17 on the walls and/or in the ceiling regions of the space. These passive treatments result in a relatively steep reverberation slope S1 and provide a baseline RT value for the space. FIG. 2B shows the contribution from the enhanced reverberation system. It is seen that this active component of the system produces a relatively long, shallow reverberation slope S2 resulting in larger effective RT value for the space. FIG. 2C shows a combination of the two slopes, that is, the combination of the effects of the passive and active components of the system. The result is "double sloping" as indicated by the composite double slope DS. Here, the initial decay, which provides the baseline RT value, is governed by the steep reverberation slope imposed by the passive component of the system, and the decay beyond the initial decay is governed by the active component of the system. As a result of this double sloping, quieter sounds such as table conversations are in the upper steep slope and louder ambient sounds (the background din within the space) are in the lower shallower slope. The active component of the system will act to blur the louder background sounds, making conversation at lower sound levels more intelligible.

Figure 3:
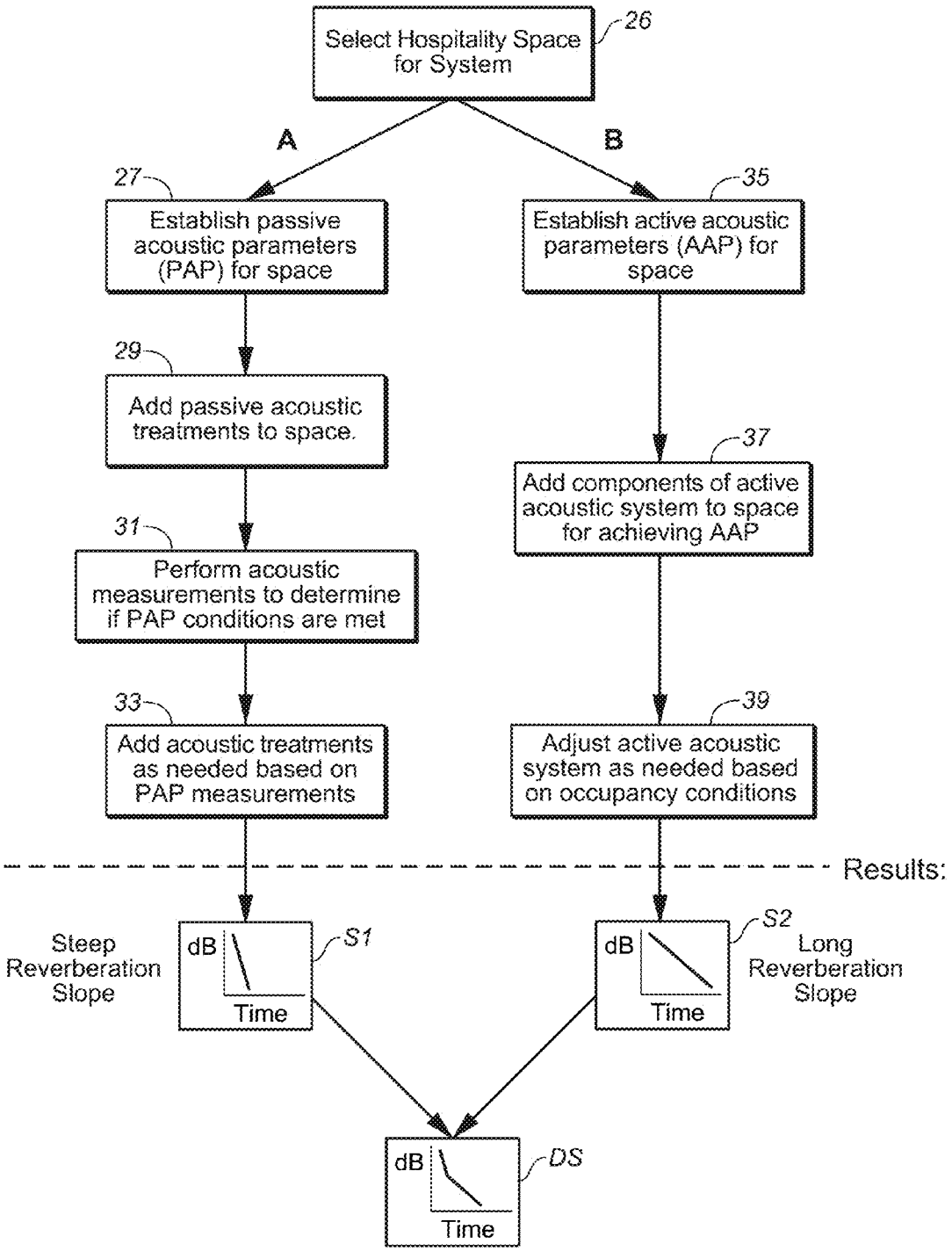
FIG. 3 is a flow chart generally illustrating the general hospitality space design principles of the invention.

The flow chart of FIG. 3 illustrates the earlier described method for controlling acoustic environments within hospitality spaces. Once the hospitality space is selected (block 26), there are two basic design process paths (denoted "A" and "B" in FIG. 3) necessary for creating an acoustic control system for the selected space in accordance with the invention. One is to design and install the passive component of the system (process steps A) and the other is to design and install the active components of the space (process path B). The design processes can be conducted concurrently or in either order, however, in practice the passive component of the system will most suitably be installed before the active component.

In regard to the design process and installation for the passive component, the first step, denoted by block 27, is to establish the passive acoustic parameters (baseline RT value or values) for the space. Once these parameters have been established, passive acoustic treatments are added to the space (block 29). The next step, represented by block 31, is to perform acoustic measurements of the space to determine if the established parameters have been met, and to add further passive acoustic treatments as needed to achieve the established parameters (block 33).

In regard to the active acoustic component of the system, the active acoustic parameters must first be established for the space as denoted by block 35. Once these parameters have been established, the components of the active acoustic system are added to the space for achieving the active acoustic parameters (block 37). Thereafter, the active components of the system can be adjusted as earlier described as needed to adjust for the occupancy conditions of the space (block 39).

Figure 4:
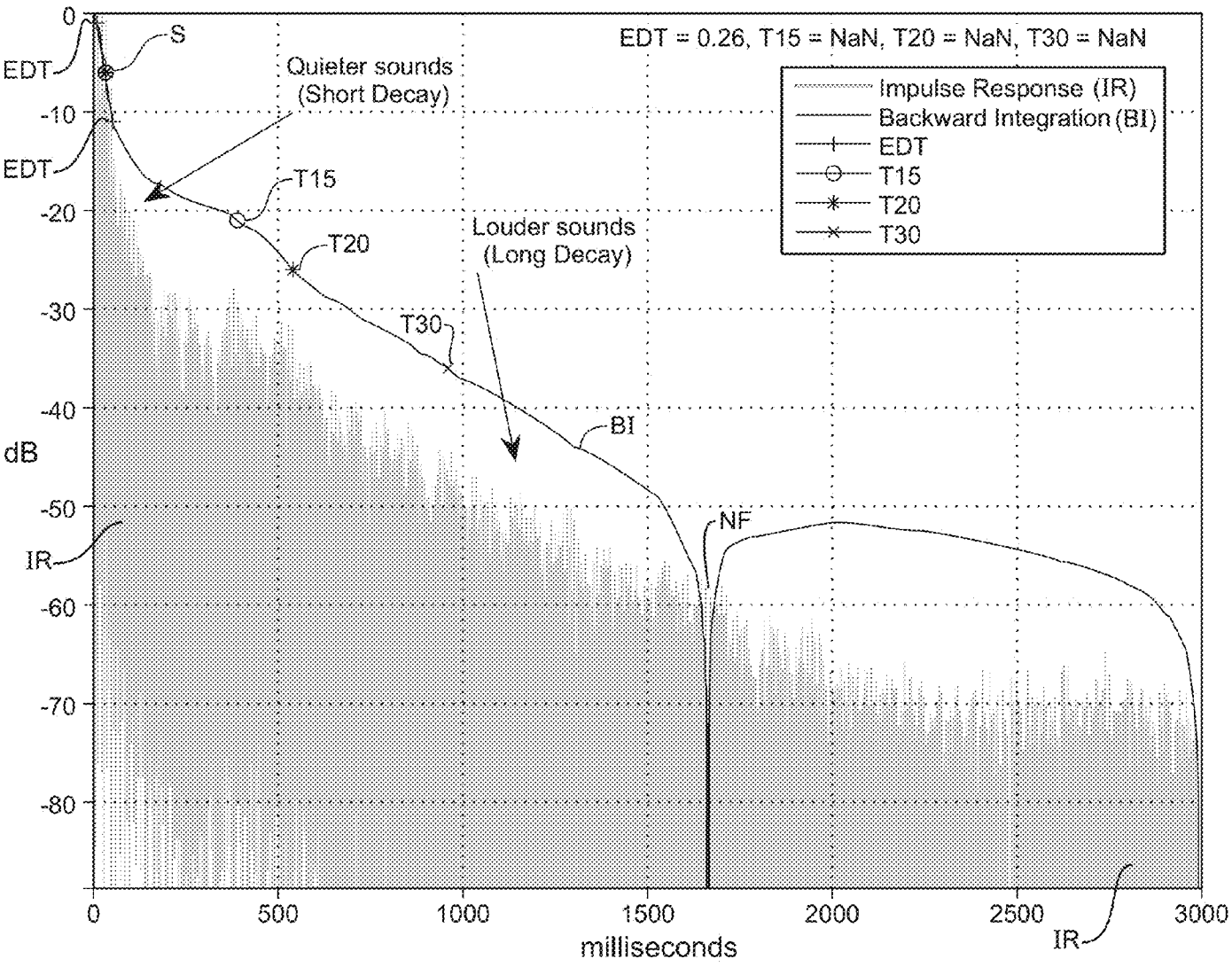
FIG. 4 is an impulse response graph for an exemplary hospitality space employing a dynamic acoustic control system in accordance with the invention and illustrating the contributions of the passive and active components of the system.

FIG. 4 shows an impulse response graph for an exemplary hospitality space having an installed dynamic acoustic control system in accordance with the invention. The double sloping of the reverberation times graphically illustrated in FIG. 2C is evident in this impulse response. It is seen that within the first approximately 200 milliseconds the impulse response, denoted "IR," experiences a short decay time corresponding to a steep reverberation slope such as graphically illustrated in FIG. 2A. After this initial time interval the response changes to a long decay corresponding to a shallow slope as graphically illustrated in FIG. 2B. The initial steep reverberation slope is where the passive component of the system dominates and will provide "dry" acoustic zones for close, localized sounds such as sounds produced by persons conversing near each other. These localized sounds, while being loud enough to be heard between persons within close proximity to each other, will be quieter from the perspective of the active system, and therefore will not be loud enough to excite the reverberator in the active system. The shallow slope resulting from the presence of the active component in the system will be excited by the cumulative ambient sounds in the space, and particularly will allow these cumulative sounds to be reverberated to produce blurring of the ambient sounds. Since the microphones of the active component are elevated and located away from the persons in the space, they are picking up the different sounds produced in a large area of the space. Also, because the active component is comprised of several microphones, and because multiple sound sources result in a cumulative increase in sound level, a significant amount of sound energy is picked-up by the system's active component (that is, the non-in-line reverberation system graphically illustrated in FIG. 1). This cumulative effect is enough to excite the system's active component (the reverberator). Thus, the reverberant sound reintroduced into the space by the system's active component is comprised of sounds from all over the space. The ability to pick-up and adjust the RT value of this ambient sound and then reintroduce it into the space in accordance with the invention gives the user the ability to control the effect of the background ambient sounds on local sound environments where conversations occur. As above-described, the system of the invention will give the user the ability to create a "blurring" effect in the background sounds, which will advantageously enhance the ability of persons within the space to hear sounds, such as conversations, from local sources.

It will be appreciated that equalization can be added to the system to cancel out unwanted louder sounds, such as certain kitchen noises, such as clanking dishes or utensils.

A backward integration of the impulse response indicated on the graph by trace "BI," indicates the acoustic energy in the space at a point in time. (The backward integration should begin at the noise floor (−60 dB), which in the FIG. 4 graph is about 1700 milliseconds. In FIG. 4 the backward integration began at 3000 milliseconds based on a guess of where the noise floor began before the impulse response was known. This resulted in the dip in the BI curve at the point (NF) where the noise floor of the impulse response actually began.) It is noted that the impulse response graph in FIG. 4 also indicates the early delay time (EDT), that is the time it takes for the acoustic energy to decay from about 0 dB to about −10 dB, along with times T15, T20 and T30, that is the points where the acoustic energy as represented by the BI curve decays respectively by 15 dB, 20 dB and 30 dB from the 5 dB down point (P) on the BI curve.

While the invention has been described in considerable detail in the foregoing specification and the accompanying drawings, it is not intended that the application be limited to such detail.

We claim:

1. An acoustic control system for hospitality spaces, a hospitality space having walls and ceiling areas, and wherein persons within the space will be exposed to localized sounds within the space, the sources of which are close to such persons, and to ambient sounds produced throughout the space by different sources within the space, said acoustic control system comprising:

a passive component comprised of acoustic absorbent material placed in the hospitality space, said acoustic absorbent materials being selected and placed in the hospitality space for producing a baseline reverberation time (RT) value within the hospitality space, wherein the baseline RT value is characterized by a relatively steep reverberation slope, and an active component for picking up ambient sounds in the hospitality space and reintroducing the ambient sounds into the hospitality space such that the reintroduced ambient sounds have an RT value capable of being adjusted and such that the active component produces an effective RT value for sound reintroduced into the hospitality space that can be adjusted to a relatively large value as compared to said baseline RT value, and wherein the effective RT value for ambient sound reintroduced into the hospitality space has a characteristic reverberation slope that is less steep than the characteristic slope for the baseline RT value, wherein a composite reverberation slope results from the characteristic reverberation slopes produced by the passive and active components of the system, and further wherein said composite reverberation slope is a double slope representing a short decay time for localized sounds in the hospitality space and longer decay time for ambient sounds reintroduced into the hospitality space by said active component.

2. The acoustic control system of claim 1 wherein the passive component is comprised of acoustic absorbent material applied to at least the ceiling areas of the hospitality space.

3. The acoustic control system of claim 1 wherein the passive component is comprised of acoustic absorbent material applied to both ceiling areas and walls of the hospitality space.

4. The acoustic control system of claim 1 wherein said active component is comprised of a plurality of microphones distributed in the hospitality space for picking up ambient sounds in the hospitality space and a plurality of loudspeakers distributed in the hospitality space for reintroducing sound picked up by said microphones into the hospitality space, wherein the RT value of the ambient sound reintroduced into the hospitality space by the active component can be adjusted to an RT value larger than the baseline RT value.

5. The acoustic control system of claim 4 wherein said plurality of microphones and loudspeakers is located in the overhead regions of the hospitality space for picking up and reintroducing ambient sound into the hospitality space.

6. The acoustic control system of claim 4 wherein the baseline RT value is no greater than about 700 milliseconds.

7. The acoustic control system of claim 4 wherein the baseline RT value is between about 300 and about 700 milliseconds.

8. The acoustic control system of claim 4 wherein the baseline RT value is between about 300 and 500 milliseconds.

* * * * *